US006350183B2

(12) United States Patent
Manfredi

(10) Patent No.: US 6,350,183 B2
(45) Date of Patent: Feb. 26, 2002

(54) HIGH PRESSURE CLEANING

(75) Inventor: Paul A. Manfredi, Waterbury Center, VT (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/371,421

(22) Filed: Aug. 10, 1999

(51) Int. Cl.[7] ..... B24B 1/00

(52) U.S. Cl. ..... 451/56; 451/60; 451/72; 451/444

(58) Field of Search ..... 451/56, 59, 60, 451/63, 72, 443, 444, 36, 39, 40, 91, 99

(56) References Cited

U.S. PATENT DOCUMENTS 4,932,168 A * 6/1990 Tada et al. ..... 51/436
5,154,021 A 10/1992 Bombadier et al.
5,390,450 A * 2/1995 Goenka ..... 451/75
5,531,861 A 7/1996 Yu et al.
5,578,529 A 11/1996 Mullins
5,597,443 A 1/1997 Hempel
5,616,069 A * 4/1997 Waker et al. ..... 451/56
5,667,424 A 9/1997 Pan
5,716,264 A * 2/1998 Kimura et al. ..... 451/443
5,785,581 A * 7/1998 Settles ..... 451/99
5,868,608 A * 2/1999 Allman et al. ..... 451/72
5,896,870 A 4/1999 Huynh et al.
5,913,715 A * 6/1999 Kirchner et al. ..... 451/56
5,957,757 A * 9/1999 Berman ..... 451/56
6,012,968 A * 1/2000 Lofaro ..... 451/39
6,053,801 A * 4/2000 Pinson et al. ..... 451/56

* cited by examiner

*Primary Examiner*—Timothy V. Eley
*Assistant Examiner*—Dung Van Nguyen
(74) *Attorney, Agent, or Firm*—Robert A. Walsh

(57) ABSTRACT

A method and apparatus for chemical mechanical polishing a semiconductor wafer by providing a novel high pressure mixture of gas and liquid in a pulsation mode for eliminating residual slurry, by-products, and slurry abrasive particles on or in the polishing pad.

20 Claims, 1 Drawing Sheet

HIGH PRESSURE CLEANING

BACKGROUND OF THE INVENTION

1. Technical Field

The present invention relates generally to manufacturing semiconductor wafers and more particularly the invention pertains to the field of Chemical Mechanical Polish (CMP) used during the fabrication of semiconductor chips to planarize the wafers.

2. Background Art

Rapid progress in semiconductor device integration demands smaller and smaller wiring patterns or interconnections which connect active areas. As a result, the tolerances regarding the planeness or flatness of the semiconductor wafers used in these processes are becoming smaller and smaller. One customary way of flattening the surfaces of semiconductor wafers is to polish them with a polishing apparatus.

Such a polishing apparatus has a rotating wafer carrier assembly in contact with a polishing pad. The polishing pad is mounted on a rotating turntable which is driven by an external driving force. The polishing apparatus causes a polishing or rubbing movement between the surface of each thin semiconductor wafer and the polishing pad while dispersing a polishing slurry to obtain a chemical mechanical polish (CMP). CMP in planarization requires the wafer surface to be brought into contact with a rotating pad saturated with either a slurry of abrasive particles or a reactive solution, or both, that attacks the wafer surface. This is done while exerting force between the wafer and polishing pad. The abrasive particles can scratch the surface during the polish operation especially if they agglomerate or if abrasive material becomes embedded in the polishing pad. Also, after polishing is completed and the wafer is rinsed to remove the abrasive particles, some of the abrasive particles will remain on the wafer surface or pad by simply being imbedded into the surface or strongly attracted to the surface.

The scratches can cause problems in subsequent processing steps as for example in a Damascene process, intra-level where shorting could result. Leaving the particles on the wafer or pad can likewise lead to process problems, most notably photolithographic and etching defects in subsequently processed levels.

Prior art for particle removal involves either a mechanical clean, such as a brush clean, after the wafers have been removed from the polishing apparatus and dried, or a washing step with a surfactant (soap) performed prior to the wafer being dried as disclosed in U.S. Pat. No. 5,320,706, issued to Blackwell on Jun. 14, 1994 and assigned to Texas Instruments Incorporated. These processes are not usually 100% effective and do not address the scratching problem. Therefore, it appears that no prior art per se exists that addresses the scratching problem directly.

SUMMARY OF THE INVENTION

The present invention discloses a method and apparatus for removing slurry abrasive particles in a polishing process for planarization of a semiconductor wafer.

The present invention discloses a method and apparatus for reducing the size of the slurry abrasive particles or agglomerations of slurry abrasive particles in a polishing process for planarization of a semiconductor wafer.

The present invention disclose a method for reduction in size of agglomerations and removal of abrasive particles from the polishing pad during a polishing process for planarization of a wafer, comprising: applying a high pressure mixture of gas and liquids to the polishing pad to reduce and remove the agglomeration of abrasive particles.

The present invention is a method for removal of abrasive particles and conditioning the polishing pad during a polishing process for planarization of a wafer, comprising: applying a high pressure mixture of gas and liquid to the polishing pad to remove the abrasive particles and condition the pad.

The present invention discloses an apparatus comprising: a wafer; a polishing pad which planarizes the wafer; a slurry dispenser which provides slurry containing abrasive particles to the polishing pad; and a high pressure fluid dispenser which controllably provides a mixture of gas and fluid to the polishing pad.

In accordance with the above, it is an advantage of the present invention to solve the problem of slurry abrasive particle removal post-CMP and the problem of scratches on the post-CMP surface.

It is an advantage of the present invention to remove the abrasive particles from the pad.

It is an advantage of the present invention to rapidly remove and reduce the abrasive particle size while conditioning the pad.

It is an advantage of the present invention to rapidly reduce the size of agglomerations of abrasive particles.

It is an advantage of the present invention to eliminate residual slurry and slurry abrasives and particulates from the polishing pad. It is an advantage of the present invention to break up or reduce the size of abrasive particle agglomerations.

It is an advantage of the present invention to eliminate slurry abrasive particle residues and reduce if not eliminate the sources of scratches.

DETAILED DESCRIPTION OF THE PREFERRED EMBODIMENT

Figure 1:
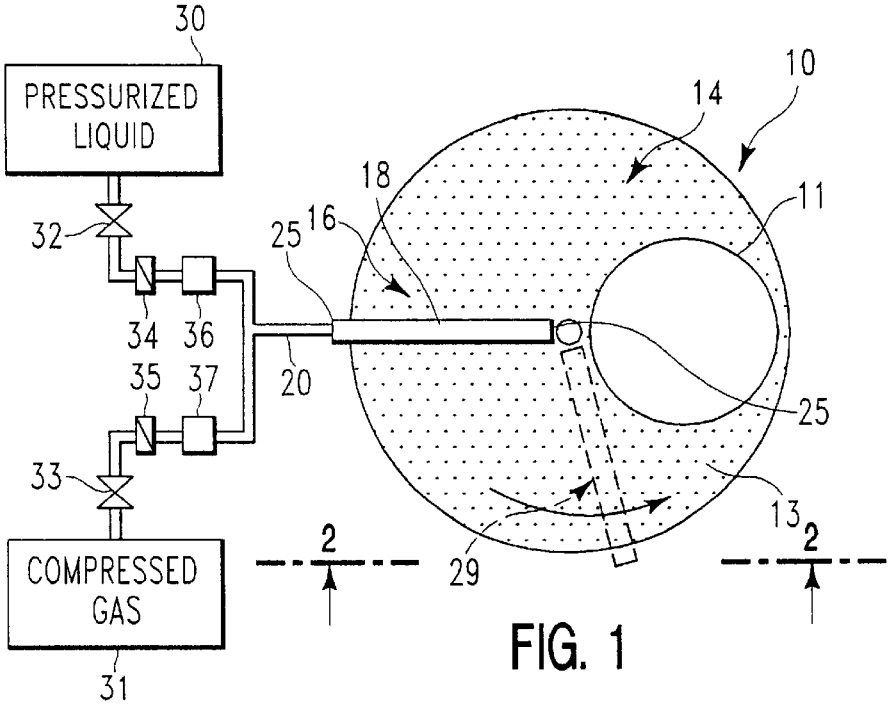
FIG. 1 is a top plan view of a high pressure apparatus constructed according to the present invention located over a polishing pad.
Figure 2:
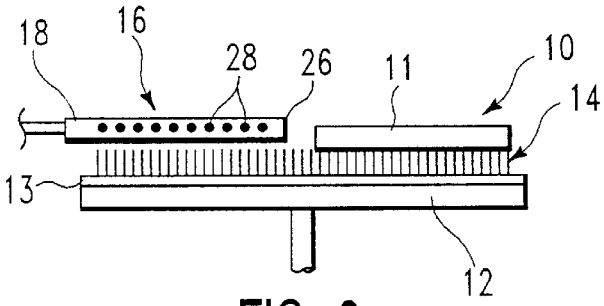
FIG. 2 is a longitudinal sectional view of the high pressure apparatus and polishing pad taken substantially along the plane described by the lines 2—2 of FIG. 1.
Figure 3:
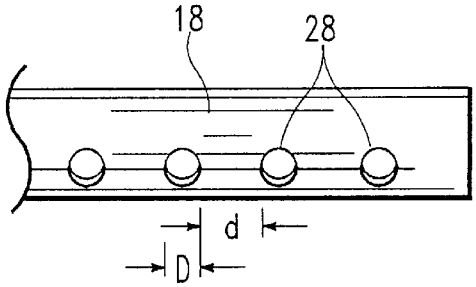
FIG. 3 is a view of a portion of the high pressure apparatus as shown in FIG. 2 on an enlarged scale.

Referring to the drawings, and initially to FIGS. 1–3, a polishing pad, indicated generally at 10, is designed to polish a surface of a semiconductor wafer (indicated at 11) during the wafer fabrication process. The polishing process and the operation of the device of this invention will be described as they related to the Chemical Mechanical Planarization (CMP) process, as described in U.S. Pat. No. 4,793,895 which is assigned to the assignee of the present invention. It will be understood, however, that the apparatus and process with this invention can be used with other processes which remove different materials e.g., oxides, polysilicon and aluminum, from the surface of the semiconductor wafer.

The pad 10 is substantially circular in top plan view and is supported on a rotatable platen 12. The pad 10 may be composed of number of elongated fibers 14, normally extending substantially perpendicular to the upper surface of the pad for contacting and polishing the surface of the semiconductor wafer. The pad 10 is backed with an impervious surface 13 such as polyethylene terephthalate (i.e., MYLAR). A chemical, appropriate to the material being polished plus a suitable abrasive, is continuously applied, in the form of a slurry, to the pad to remove the unwanted material from the wafer during the polishing process. An effector (not shown) may be applied to the pad to assist in conditioning the surface of the pad. The effector may have abrasive material such as diamond material embedded in its surface to assist in the conditioning. This material may break off and become embedded in the pad.

During the semiconductor wafer fabrication process, the fibers 14 tend to become flattened during the polishing process Moreover, polishing by-products, abrasive material from the effector, and spent polishing material tend to become imbedded in the fibers of the pad. Additionally, a "glazed" effect becomes apparent on the surface of the polishing pad. The flattened fibers and the imbedded polishing by-products and spent polishing material degrades the polishing efficiency of the pad. Further, the abrasive material from the effector may cause severe scratching which would damage the wafer.

According to the present invention, a high pressure assembly, indicated generally at 16, is supported in spaced relationship to the surface of the polishing pad. The high pressure assembly 16 includes an elongated pipe 18 coupled by a flexible tube 20 to a source of a liquid and gas mixture. The mixture is created from a source of pressurized liquid 30 and compressed gas 31.

The pressurized liquid, such as water, is fed through a control valve 32 and check valve 34 to a flow meter controller 36 prior to being mixed with the compressed gas. The compressed gas, such as air, is fed through a control valve 33 and check valve 35 to a flow meter controller 37 prior to being mixed with the pressurized liquid.

The elongated pipe 18 is formed from rigid plastic or other appropriate material and preferably extends radially inward toward the rotational axis of the polishing pad. One end of the pipe 18 includes an inlet port 25 connected to the flexible tube 20, while the other end is closed by an end cap 26. The pipe 18 of the high pressure assembly can be pivotally connected on a swivel block (not shown) to the support structure of the platen. Accordingly, the pipe 18 can be moved away from the platen during replacement of the polishing pad.

As illustrated in FIGS. 2 and 3, a plurality of perforations, about 22 in number, as indicated at 28, are formed in the wall of the pipe 18. Each of the perforations 28 has a diameter D. The perforations are preferably equally spaced at d intervals along the length of the pipe 18. The distance d between the edges of the perforations and the diameter of the perforations is preferably equal. It has been determined that for the above-described process the diameter D and distance d should be approximately ⅛". Alternatively, it is also within the scope of the invention to provide a thin slot extending along the length of the pipe in lieu of the perforations.

The compressed gas supply 31 is conventional in design and provides compressed air (or other appropriate gas) at a predetermined pressure that is adjusted by the control valve 33 and the rate of flow by flow meter 37.

Likewise, the pressurized liquid 30 is conventional in design and provides high pressure liquid such as water (or other appropriate liquid) at a predetermined pressure that is adjusted by control valve 32 and the rate of flow by flow meter 36. The mixture of gas and fluid is supplied through the flexible tube 20 to the inlet port 25 of the pipe 18. The mixture fills the pipe and is forced through the perforations 28 in a substantially uniform stream. The perforations 28 direct the flow downwardly against the surface of the polishing pad at an angle Ø, which angle is approximately 45 to 90 degrees and preferably about 90° in the direction of rotation of the platen.

As illustrated most clearly in FIG. 1, as the platen 12 is rotated, the chemical slurry is applied through an applicator, as indicated generally in phantom at 29, to the fibers of the polishing pad. The fibers move across the surface of the wafer as the polishing pad rotates. The action of the chemical slurry and the pad removes the material from the wafer being polished. However, the polishing by-products, along with other unwanted abrasive materials becomes imbedded in the fibers of the pad. Additionally, the fibers on the pad may become flattened during contact with the wafer surface. The downwardly directed stream of the liquid and gas mixture as a pulsation of fluid under high pressure is applied against the surface of the polishing pad 10. The high pressure pulsation of the gas—liquid mixture tends to scrub or loosen the polishing by-products, abrasive material from the affector, and spent polishing material from the pad. The gas—liquid mixture also washes the pad and raises the flattened fibers to their normal orientation substantially perpendicular to the surface of the polishing pad. Moreover, the "eglazing" of the fibers during polishing is prevented by this blowing away of the material and the polishing by-products. As the platen continued to rotate, the raised fibers are again coated with the chemical slurry and contact and polish the surface of the semiconductor wafer. Although the high pressure system may be used to thoroughly clean and condition the pad during polishing, it has been found most effective if used as a pre-polishing or post-polishing step in the CMP process.

Tests have been conducted using the high pressure assembly supported over a polishing pad where 8" semiconductor wafers were being polished. The pad was rotated on the platen at a rate of 35 rpm. The perforations in the pipe provide the gas—liquid mixture under pressure in about a 1:1 ratio in order to create a pulsating effect. The gas is supplied with a flow from 10 to 300 CFM and preferably set at about 250 CFM. The flow of the liquid is adjusted to supply liquid at 1 to 4 GPM. The system uses matched pressures of about 40 PSI (approximately in a 1:1 ratio), gas and liquid to create the pulsation of gas—liquid stream at inlet 25. It has been determined that the high pressure assembly removed the spent polishing materials and by-products including the abrasive effector material from the pad and raises the flattened pad fibers. It has further been determined that the high pressure assembly thoroughly cleans the pad from all unwanted materials and may be effectively used to reduce unwanted scratches occurring on the wafers.

Accordingly, the present invention provides a high pressure apparatus which is simple and convenient to use and which efficiently removes spent polishing materials and by-products from the surface of a polishing pad by the pulsation action of the mixture of gas and liquid.

Although the invention has been shown and described with respect to a certain preferred embodiment, it is obvious that equivalent alterations and modifications will occur to others skilled in the art upon their reading and understanding of the specification. For example, fluids such as water, solvents, the polishing fluid or the like can be substituted for the air discussed above. The present invention includes all such equivalent alterations and modifications, and is limited only the scope of the following claims.

What is claimed is:

1. An apparatus comprising:

an elongated conduit supported in spaced relation to a surface, said conduit having an inlet and an outlet, said inlet being coupled to mixture of a first gas at a first pressure above atmospheric pressure and a first liquid at a second pressure above atmospheric pressure, said mixture forced through said elongated conduit and out through said outlet to provide a pulsating mixture of said gas and said liquid directed toward the surface.

2. An apparatus as in claim 1, wherein the flow of the gas in the conduit is between 10 to 300 CFM.

3. An apparatus as in claim 2, wherein the flow of the gas is about 250 CFM.

4. An apparatus as in claim 1, wherein the flow of the liquid is between 1 to 4 GPM.

5. An apparatus as in claim 4, wherein the pressure of the liquid and gas is about 40 PSI.

6. An apparatus as in claim 1, wherein said liquid is water which is pressurized to about 40 PSI and provides a flow at about 1 to 4 GPM and wherein said gas is air with a flow of about 250 CFM.

7. An apparatus as in claim 1, wherein said mixture comprises said gas and said liquid in approximately a 1:1 ratio.

8. An apparatus as in claim 1, wherein said pulsating mixture of said gas and said liquid is directed toward the surface at an angle from about 45 degrees to about 90 degrees.

9. An apparatus as in claim 8, wherein said angle is approximately 90 degrees.

10. An apparatus as in claim 1, wherein said surface is the surface of a polishing pad.

11. An apparatus as in claim 10, wherein spent polishing material and by-products tend to become imbedded in said polishing pad during polishing of a semiconductor wafer, and said outlet of said elongated conduit is adapted to provide the pulsating mixture to scrub away and wash said spent polishing material and by-products from the surface of said polishing pad.

12. An apparatus as in claim 11, wherein said polishing pad is substantially circular in top plan view and said elongated conduit extends substantially across the radius of said polishing pad.

13. An apparatus as in claim 12, wherein said outlet of said conduit comprises plurality of openings equally spaced across said elongated conduit.

14. An apparatus as in claim 13, wherein said plurality of openings extend across the radius of said polishing pad.

15. An apparatus as in claim 10 further comprising a rotatable platen, wherein said polishing pad is supported on said platen, said polishing pad having fibers normally extending substantially perpendicular to said surface of said polishing pad and tending to flatten against said surface during polishing of a semiconductor wafer.

16. An apparatus as in claim 1, wherein said pulsating mixture of said gas and said liquid thoroughly cleans or conditions said surface.

17. A method for reconditioning a polishing pad having flattened fibers for polishing a semiconductor wafer, comprising the steps of:

rotating the polishing pad, supporting an elongated conduit in spaced relation to a surface of said polishing pad in contact with the wafer, said conduit having an inlet and an outlet, forcing a mixture of a first gas and a first liquid in about a 1:1 ratio through said inlet into said conduit and out through said outlet, said outlet directing a pulsating mixture of gas and liquid against the polishing pad at about 45 to 90 degrees to the direction of rotation of the polishing pad to thoroughly clean said polishing pad.

18. A method for reconditioning a polishing pad as in claim 17, wherein the mixture is air and water which is forced through plural openings in said outlet of said conduit at an angle of approximately 90° in the direction of rotation of said polishing pad.

19. A method for reconditioning a polishing pad as in claim 18 wherein the water is pressurized to about 40 PSI with a flow of 1 to 4 GPM and the air is pressurized to about 40 PSI with a flow of about 250 CFM.

20. An apparatus for polishing a semiconductor wafer having a layer of material applied to a surface, comprising:

a rotatable platen, a polishing pad supported on said platen, and adapted to be coated with a material removing solution, said polishing pad adapted to be brought into contact with the surface of the semiconductor wafer to selectively remove the material during the polishing of the semiconductor wafer, said polishing pad tending to have spent polishing material and by-products imbedded in said pad during contact with the surface of the semiconductor wafer, and an elongated conduit supported in spaced relation to said polishing pad, said conduit having an inlet port and a plurality of outlet ports, said inlet port being coupled to an air supply at a first pressure above atmospheric pressure and a water supply at a second pressure above atmospheric pressure, and said outlet ports being directed toward the upper surface of said polishing pad, said gas supply adapted to provide the mixture of air and water in a ratio of 1:1 through said outlet ports in a pulsation mode substantially perpendicular to said polishing pad to wash and scrub away the spent polishing material and by-products from the polishing pad.

* * * * *